United States Patent [19]

Kervistin

[11] Patent Number: 4,668,163

[45] Date of Patent: May 26, 1987

[54] AUTOMATIC CONTROL DEVICE OF A LABYRINTH SEAL CLEARANCE IN A TURBO-JET ENGINE

[75] Inventor: Robert Kervistin, Le Mee Sur Seine, France

[73] Assignee: Societe Nationale d'Etude et de Construction de Moteurs d'Aviation S.N.E.C.M.A., Paris, France

[21] Appl. No.: 780,440

[22] Filed: Sep. 26, 1985

[30] Foreign Application Priority Data

Sep. 27, 1984 [FR] France ..... 84 14818

[51] Int. Cl.[4] ..... F01D 25/12

[52] U.S. Cl. ..... 415/116; 415/115

[58] Field of Search ..... 415/170 R, 174, 175, 415/115, 116

[56] References Cited

U.S. PATENT DOCUMENTS

| | | | |
|---|---|---|---|
| 3,018,085 | 1/1962 | Welsh | 415/136 |
| 3,527,053 | 9/1970 | Horn | 415/174 |
| 3,989,410 | 11/1976 | Ferrari | 415/174 |
| 4,060,250 | 11/1977 | Davis | 415/174 |
| 4,103,899 | 8/1978 | Turner | 277/1 |
| 4,177,004 | 12/1979 | Riedmiller et al. | 415/136 |
| 4,295,787 | 10/1981 | Lardellier | 415/174 |
| 4,320,903 | 3/1982 | Ayache et al. | 415/174 |
| 4,466,239 | 8/1984 | Napoli et al. | 415/116 |
| 4,513,975 | 4/1985 | Hauser et al. | 415/174 |
| 4,526,226 | 7/1985 | Hsia et al. | 415/116 |
| 4,527,385 | 7/1985 | Jumelle et al. | 415/138 |
| 4,554,789 | 11/1985 | Napoli et al. | 415/112 |
| 4,573,865 | 3/1986 | Hsia et al. | 415/115 |

FOREIGN PATENT DOCUMENTS

| | | |
|---|---|---|
| 1961321 | 7/1970 | Fed. Rep. of Germany . |
| 2025869 | 9/1970 | France . |
| 2280791 | 2/1976 | France . |
| 2437544 | 4/1980 | France . |

*Primary Examiner*—Robert E. Garrett
*Assistant Examiner*—John Kwon
*Attorney, Agent, or Firm*—Oblon, Fisher, Spivak, McClelland & Maier

[57] ABSTRACT

An assembly to control automatically the clearance of a labyrinth seal of the turbo machine, including a stator member is provided which includes an annular chamber supplied with a hot air flow through orifices and a colder air flow supplied through apertures formed in the radially inner part of the stator member constituting the annular carrier of a wear seal member which forms with tips carried by the one part of the rotor the labyrinth seal, these apertures being disposed upstream of the seal. The apertures lie in the zone of corresponding parts of the carrier and of the rotor part which are so shaped as to create a annular convergent-divergent annular nozzle forming a throat. The clearance of the seal is maintained constant due to relative variations effected in the air flows and, in the sense of heating up in the case of a reduction of clearance and in the sense of cooling down in the case of an increase in clearance.

3 Claims, 2 Drawing Figures

AUTOMATIC CONTROL DEVICE OF A LABYRINTH SEAL CLEARANCE IN A TURBO-JET ENGINE

BACKGROUND OF THE INVENTION

1. Field of the Invention

This invention relates to an automatic control device operable on the clearance of a labyrinth type of a turbo machine seal.

2. Description of the Prior Art

Seal means between fixed and rotary parts of turbo machines frequently take the form of labyrinth seals comprising on the rotary part annular tip members in numbers varying according to operational conditions and in accordance with various operational technologies, and on the fixed part of the machine disposed opposite to the tip members, a member serving as a wear and fluid-tight seal, generally known as an "abradable". Such abradables are wearable by friction in the event of contact with a tip member (herein referred to as a tip) without giving rise to appreciable damage to the latter. Herein, the annular wear and fluid-tight seal will be referred to as "the wear seal member". Such labyrinth seals can be disposed for example between various movable stages of a compressor or a turbine, and fixed parts (or parts rotating at a different speed) adjacent thereto. The tips are in this case carried by intermediate rings or other means and the wear seal member is secured on the stator (or the rotary part moving preferably at the lower speed).

In a particular utilization of such labyrinth seals which forms an application more directly envisaged by the invention, these seals are disposed between various enclosures of the turbo machine and are to be found in particular at the ends of the outer enclosed spaces of the combustion chamber. On the one hand, on the outlet side of the compressor and, on the other hand, on the inlet side of the turbine. In this case the actual fluid-tight function of the labyrinth seal is more complex. In practice, balancing of the pressures between the various enclosures of the turbo machine is conventionally sought. A controlled air flow is also sought within the enclosures with a view to generating necessary cooling air flows eventually used in other zones of the turbo-machine and thus it may be desirable to control with high precision the air flows termed "loss flows+ traversing a labyrinth seal and of which the precise control affects various parameters such as the efficiencies of the turbo machine or the useful life of the various parts. Apart from these various operational conditions, such as the pressure within the enclosures, one of the fundamental parameters from which this control of the air flows depends is the clearance during operation between the upper part of the tips and the wear seal member.

Various proposals have been made with a view to overcoming these problems and in particular maintaining a control value of the clearance between the tips and the wear seal member in a labyrinth seal, whatever the operational conditions of the turbo-machine, at a stabilized rating or during transitory phase ratings. Thus, FR-A-No. 2 437 544 invented by the present Applicant describes a labyrinth seal in which the carrier of the wear seal member is surrounded by an annular duct connected, at its downstream end, to an air supply provided in the wall of the combustion chamber casing while its other end discharges upstream of the labyrinth seal into the space with air at a lower pressure surrounding the shaft of the compressor. The control of the amount of cooling air flow at the labyrinth seal relies in this case upon a controllable discharge valve operably dependent upon an operational parameter of the turbo machine. This control method has however, various disadvantages inherent in the method because it relies, on the one hand, upon a complex control chain thus multiplying the risks of failure or defective operation of the valves and other accessories and, on the other hand, the response time, particularly during transitory phase ratings, may be too long to ensure fully satisfactory operation.

Another device proposed in FR-A-No. 2 025 869 seeks to minimize the difference in thermal expansions in a labyrinth seal by an equalization of the temperatures between a casing supporting the wear seal member and a ring carrying the tips and connected to the rotor. With this objective, the outer surface of the casing is isolated from the flow of hot gases by a screen defining a space in which cooling air circulates. This proposal, however, does not provide any specific adaptation as a function of variations in the operational conditions of the turbo machine, in particular during transitory phase ratings.

SUMMARY OF THE INVENTION

An object of the present invention is resolution of these problems by avoiding the disadvantages of the known prior proposals.

A more specific object during the build up to operation at full gas supply by rapid acceleration, is to ensure a minimum clearance between the tips of the tip members and the cooperating surface of the wear seal member of the labyrinth seal and also, in the case of a rapid deceleration, of avoiding any penetration of the tips into the wear seal member, which will give rise, apart from various mechanical difficulties (vibratory phenomena, heating up leading to divergent effects), to the ultimate generation of clearances which are too great and clearly prejudicial to overall efficiency. During this latter transitory phase of deceleration, in practice, a minimum clearance must be maintained in order to enable a following rapid phase or re-acceleration.

According to the present invention there is provided a labyrinth seal assembly comprising a plurality of rotary annular tip members, a rotor supporting the tip members, an annular wear seal member co-operating with the tip members, an annular carrier supporting the wear seal member rotatable at most at a lower speed than the rotary annular tip members, the annular carrier having a series of peripherally distributed apertures supplied with cooling air from the air flow controlled by the labyrinth seal, an annular stator member carrying the annular carrier and defining an annular chamber having radially outer inlet orifices for receiving hot air and radially inner outlet orifices at a downstream part thereof for the exhaust of said air, said annular chamber containing an annular thin metallic sheet member provided with a multiplicity of holes and serving to divide the annular chamber into radially inner and radially outer sections, the member being arranged to direct an air flow through the holes therein on to the carrier, the overall arrangement being such that the labyrinth seal clearance is maintained constant automatically irrespective of the rating of an associated turbo-machine.

Advantageously, the cooperating parts of the carrier supporting the wear seal member and of the part of the rotor carrying the tips are so shaped as to create upstream of the zone including the said tips and said seal a convergent divergent nozzle of annular form defining a primary throat.

The most advantageous results are obtained when said apertures of the annular carrier are at a region on said cooperating part defining the throat of the convergent divergent nozzle, thus providing communication between the stator chamber and said primary throat of said nozzle.

BRIEF DESCRIPTION OF THE DRAWING

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENT

Figure 1:
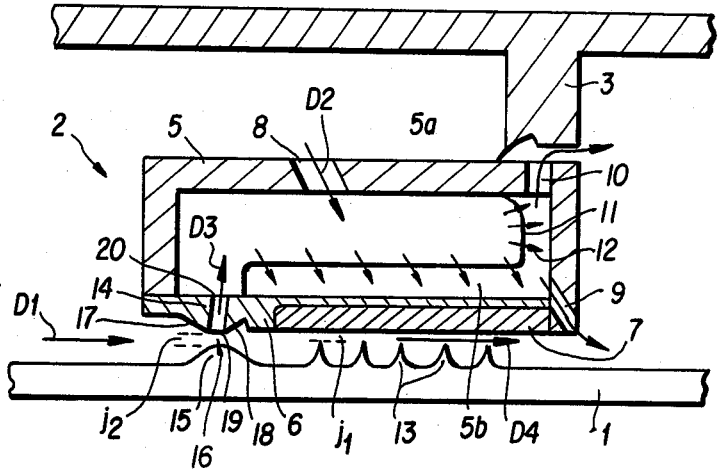
FIG. 1 is a diagrammatic longitudinal sectional view of a part of a turbo-machine comprising a labyrinth seal device in accordance with the invention.

FIG. 1 there is shown diagrammatically in axial section, under stabilized operational conditions, a part of a turbo machine comprising one embodiment of the invention. A labyrinth seal in accordance with the invention is disposed between a fixed and a movable part of the turbo machine. The rotary part is illustrated diagrammatically as a rotor 1. The fixed part comprises a stator member 2 connected to a part 3 of the fixed structure of the turbo-machine. In this stator member 2 an annular chamber 5 is provided closed at the radially inner side by an annular carrier 6 on the internal face of which is secured at its downstream part a wear seal member 7. This wear seal member is of any known type and currently used but preferably in the device in accordance with the invention, the wear seal member 7 is constituted by a honeycomb or of a type such that the flow traversing the labyrinth will not be proportional to the clearance.

The stator member 2 comprises at its outer diameter one or more orifices 8 for the supply of air and it also comprises at its downstream edge one or more orifices 9 for the discharge of air. These orifices 9 are arranged at the inner diameter of the member 2 and one or more additional orifices 10 for air discharge may be disposed at the outer diameter of the member 2, again at its downstream edge. Within the annular chamber 5 of the stator member 2 is located a thin metallic sheet member 11 and is provided with a multiplicity of small holes 12. This metallic sheet member 11 divides the annular chamber 5 into two enclosed spaces, the radially outer one **5*a* having the air inlets 8 and the other, radially inner enclosure 5*b* having the air outlet orifices 9 and possibly also orifices 10**.

In the zone of the wear seal member 7, the shaft or other rotor part 1 carries the tips 13 (five tips in the example being illustrated). The upstream part of the annular carrier 6 supporting the wear seal member as well as the part of the rotor 1 downstream of the part carrying the tips 13 comprises cooperating parts 14 on the annular member 7 and 15 on the part of the rotor 1. These parts 14 and 15 are respectively shaped so as to create within the downstream space disposed between the seal member 7 and the part of the rotor 1 a nozzle 16 comprising an upstream convergent part 17 and a downstream divergent part 18 connected by a throat 19. The downstream part of the seal member 7 comprises in the region of the throat 19 one or more apertures 20 discharging from one side of the throat 19 of the convergent divergent nozzle 16 and from the other into the outer enclosure **5*a* of the annular chamber 5 of the stator member 2**.

The device in accordance with the invention which has just been described enables improved operation while ensuring under all operational conditions of the turbo-machine both during stabilized ratings as in transitory ratings a clearance which is guaranteed to be practically constant at a control value of the air flow traversing the labyrinth seal of the turbo machine on which said device is assembled without any undesired variations of which the consequences are detrimental to efficiency of the turbo-machine or to the operational life of certain parts lying in the leakage flows in the zone of the labyrinth seal.

In practice, if the clearance between the upper part tips 13 and the corresponding internal surface of the wear seal member 7 is designated by j1 and the section at the throat 19 of the nozzle 16, during a rapid acceleration phase leading to operation at full gas of the turbo-machine is designated by j2, for example, as a result of the combined effects of expansions specifically of mechanical origin caused by centrifugal force and of thermal origin applied to the various parts of the structure, the clearance j1 may have a tendancy to decrease, as well as the section j2 at the throat 19. If the air flow at the entry to the space separating the rotor part 1 and the stator part 2 is designated by D1, this air entering at a temperature appreciably less than that of the gas in the gas flow in the region of the device, the air flow amount entering into the annular chamber 5 through the orifices 8 of the stator element 2 by D2, the point of withdrawal of this air into the turbo machine being selected so that this air will be hotter than that of D1 supplying the seal, the air flow bled from D1 at the throat 19 of the nozzle 16 through inlet orifices 20 into the annular chamber 5 by D3 and the cooling air flow traversing the labyrinth seal by D4, in such a case, a substantially insignificant variation of the flow D4 is observed while the increase in the local velocity at the throat 19 and the reduction in the static pressure gives rise to a reduction in the flow D3 while the flow D2 increases.

A relative variation of the air flows D2 and D3 thus results in supplying the annular chamber 5 with heating. The air from the outer enclosed space **5*a* of the chamber 5 impacts through the thin multi-perforated sheet metal member 11 on the annular carrier 6 and this air being heated up, causes the carrier 6 supporting the wear seal member 7, to expand substantially immediately. In this manner, the effects tending to reduce the clearance j1 are compensated for and annulled and the clearance j1** is maintained at the design value for the results envisaged during operation at stabilized ratings. In practice, it has been confirmed on the basis of this example that any tendancy for reduction in the clearance j1, whatever the origin, during the operation of the turbomachine is immediately compensated for by means of the device in accordance with the invention and the design clearance is maintained.

In a similar manner, if one passes for example to a deceleration phase of the turbo-machine, the clearance j1 can have a tendancy to increase and it is the same for the clearance j2. But in this case, if the section of the throat 19 increases and as a result the local velocity decreases and the static pressure increases, an increase in the flow D3 coupled with a decrease in the flow D2 results. A relative variation in the air flows D2 and D3 supplying the annular chamber 5 results which causes cooling. As a result, the air impacting on the carrier 6 cools the same and this carrier 6 supporting the wear seal member 7 contracts substantially immediately. In this manner, the effects tending to increase the clearance j1 are compensated for and annulled and the clearance j1 is again maintained at its design value and it will be the same under all operational conditions of the turbo machine tending to increase the clearance j1.

It will also be noted that during any variation in the conditions of operation of the turbo-machine, a relative variation between the hot air flow D2 and the cold air flow D3 supplying the chamber 5 of the stator member 2 will be observed so that the incidence on the clearance j1 of the labyrinth is in the opposite sense to the variation in clearance which will result from these conditions and these effects compensate one another in all cases and the device in accordance with the invention gives rise as a result to providing an automatic adjustment means, in real time, in the variations in clearance j1 of the labyrinth in order to maintain the predetermined design value.

Figure 2:
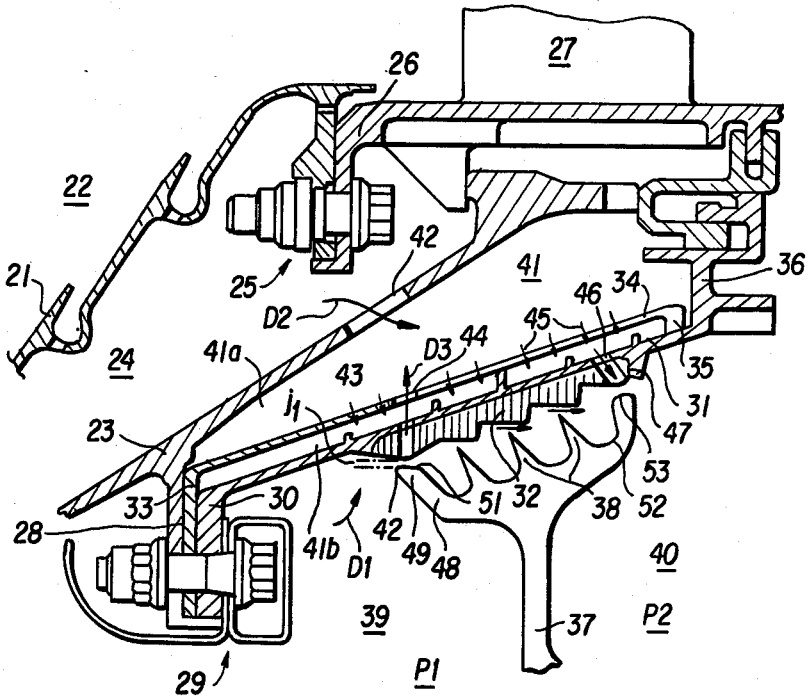
FIG. 2 is a longitudinal sectional view of a part of a turbo-machine comprising a labyrinth seal located radially inwardly of the downstream part of a combustion chamber and provided in accordance with the invention with a control device effective during operation of the turbo-machine to adjust automatically the clearance of the labyrinth seal.

FIG. 2 illustrates an embodiment for one application of the invention to a labyrinth seal disposed in the zone of the outlet of a combustion chamber on the radially inner side. In this Figure there has been shown at 21 the internal casing of a combustion chamber of annular type 22, at 23 an annular envelope defines an enclosure 24 for external cooling of the combustion chamber. The casing 21 is connected at its downstream end by securing means 25, for example a ring of bolts, to a radial flange 26 of an inner part of the vane array of the vane array 27. The envelope 23 supports a radial flange 28 directed towards the axis of the machine and on which are secured by securing means, for example bolts 29, on the one hand, to a radial flange of the end 30 of an annular carrier 31 which supports on the inner face a wear seal member 32 and, on the other hand, a radial flange of the end 33 of a thin annular, frusto-conical, metallic sheet member 34 perforated with multiple holes and slightly spaced radially outwardly with respect to the carrier 31 against which it is in radial abutment at 35 at its downstream end. At its downstream end, the carrier 31 supports a flange 36 extending radially outwardly, effecting a connection with the internal part of the stator vane array 27.

In the region of the fixed stator part of the turbo machine which has just been described, the rotary part comprises a disc 37 carrying in the example illustrated three tips 38 cooperating with the wear seal member 32. An internal enclosure is divided by the disc 37 to form an upstream enclosure 39 where the air is at the pressure P1 and a downstream enclosure 40 at a lower pressure P2. The space provided between the annular carrier 31 and the envelope of the chamber 23 constitutes an annular chamber 41 enabling cooling of the carrier 31 and separated into two enclosed spaces **41*a* and 41*b* by the annular, frusto-conical, metallic sheet member 34. To this end, an air passage through an opening 42 formed in the envelope 23 is provided between the enclosure 24 and the chamber 41. Similarly, the downstream part of the wear seal member 32, of the support 31 and of the thin metallic sheet member 34 includes openings 42, 43 and 44 cooperating to enable the passage of air towards the enclosure 41*a* of the chamber 41. The thin sheet metal member 34 comprises furthermore multiple perforations 45 for cooling by impact of the carrier 31**.

On the downstream side, the carrier 31 and the wear seal member 32 comprise, furthermore, operating holes respectively 46 and 47 for the exhaust of air from the chamber 41.

The tip-carrying disc 37 comprises at its outer diameter on the upstream side an annular member having, in section the form of a finger 38 of which the end 49 as well as the cooperating surface 50 of the upstream part of the wear seal member 32 are respectively shaped so as to create an annular nozzle of convergent-divergent form and creating a throat 51 in the region of which air bleeds open towards the chamber 41 through holes 42. Similarly, at the downstream side, the disc 37 also carries an annular member having a section in the form of a finger 52 of which the end 53 cooperates with the surface opposite thereto of the downstream part of the wear seal member 32, through which discharge exhaust openings 47.

Once again an automatic control in real time is achieved of the variations of the clearance of the labyrinth seal for maintaining it at a predetermined design value. The operation enabling the achievement of this result is identical to that which has been described hereinbefore with reference to FIG. 1.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A labyrinth seal assembly, comprising:

a plurality of rotary annular tip members, a rotor supporting the tip members, an annular wear seal member cooperating with the tip members, an annular carrier supporting the wear seal member rotatable at most at a lower speed than the tip members, the annular carrier having a series of peripherally distributed apertures for receiving cooling air from the air flow controlled by the labyrinth seal assembly, an annular stator member carrying the annular carrier and defining an annular chamber having radially outer inlet orifices for receiving hot air and radially inner outlet orifices at a downstream part thereof for the exhaust of said air, said annular chamber containing an annular thin metallic sheet member provided with a multiplicity of holes and serving to divide the annular chamber into radially inner and radially outer sections, the member being arranged to direct an air flow through the holes therein on to the carrier wherein said cooling air supplied by said apertures of said annular carrier is communicated to said annular chamber and, the overall arrangement being such that the labyrinth seal clearance is maintained constant automatically irrespective of the rating of an associated turbomachine wherein the carrier and the rotor carrying the tip member have co-operating parts so shaped as to create upstream of the zone containing said tip members and said wear seal a convergent-divergent annular nozzle of annular form defining a primary throat, wherein said peripherally distributed apertures of the annular carrier open into the region of the throat of the convergent-divergent nozzle, thus providing communication between a radially outer section of said annular chamber and said throat of said nozzle.

2. An assembly according to claim 1, wherein one of the cooperating parts comprises an annular member of finger-like section supported upstream of the tips by the rotor, the upper part of the finger-like annular member forming one side of the convergent-divergent annular nozzle wherein said peripherally-distributed apertures of said annular carrier as well as corresponding apertures respectively in the wear seal member and of the thin metallic sheet member are disposed in the region of the cooperating parts forming said convergent-divergent nozzle, thus providing communication between said annular chamber and said throat of said nozzle.

3. An assembly according to claim 2, further comprising an annular member of finger-like section disposed downstream of a last member of the tip members and supported by the rotor, apertures being provided in a downstream part of the annular carrier and in the downstream part of the wear seal member, said apertures serving to exhaust air from the annular chamber and to discharge in a zone of the throat of an annular convergent-divergent nozzle defined by cooperating parts of the peripheral tip of said member of finger like section and by the opposite surface of the wear seal member.

* * * * *